US006716065B1

(12) United States Patent
Brooks

(10) Patent No.: US 6,716,065 B1
(45) Date of Patent: Apr. 6, 2004

(54) ELECTRICAL SYSTEMS WITH PAIRED BUS CONNECTORS

(75) Inventor: Dennis L. Brooks, Aurora, CO (US)

(73) Assignee: Leftek International, LLC, Aurora, CO (US)

( * ) Notice: Subject to any disclaimer, the term of this patent is extended or adjusted under 35 U.S.C. 154(b) by 144 days.

(21) Appl. No.: 09/584,779

(22) Filed: Jun. 1, 2000

(51) Int. Cl.[7] ..... H01R 13/68; H01R 33/95
(52) U.S. Cl. ..... 439/621; 439/841; 439/858
(58) Field of Search ..... 439/621, 949, 439/49, 212, 858, 250, 251, 499, 841

(56) References Cited

U.S. PATENT DOCUMENTS

| | | | | | |
|---|---|---|---|---|---|
| 3,058,083 | A | * | 10/1962 | Schneider | 439/841 |
| 3,245,024 | A | * | 4/1966 | Evans | 439/499 |
| 4,221,455 | A | | 9/1980 | Cairns et al. | |
| 4,687,270 | A | | 8/1987 | Plyler et al. | |
| 4,726,783 | A | | 2/1988 | Nakazawa et al. | |
| 4,752,254 | A | * | 6/1988 | Inoue et al. | 439/834 |
| 4,806,118 | A | | 2/1989 | Herrmann | |
| 4,846,733 | A | | 7/1989 | Baisz | |
| 4,869,675 | A | | 9/1989 | Ogawa | |
| 4,884,050 | A | | 11/1989 | Kozel | |
| 4,944,697 | A | | 7/1990 | Dorman | |
| 5,073,131 | A | | 12/1991 | Levine | |
| 5,285,011 | A | * | 2/1994 | Shimochi | 439/621 |
| 5,314,347 | A | | 5/1994 | Colleran et al. | |
| 5,346,411 | A | | 9/1994 | Nikkinen | |
| 5,562,502 | A | | 10/1996 | Kourimsky | |
| 5,563,761 | A | | 10/1996 | Apa et al. | |
| 5,795,193 | A | * | 8/1998 | Yang | 439/621 |
| 6,227,913 | B1 | * | 5/2001 | Davis et al. | 439/621 |

* cited by examiner

*Primary Examiner*—Javaid H. Nasri
(74) *Attorney, Agent, or Firm*—Rick Martin; Patent Law Offices of Rick Martin, P.C.

(57) ABSTRACT

An electrical system includes plug fuse set (20) or fuse unit (20*a*) (20*b*), fuse connector (22) (22*a*) (22*b*) (22*c*) (22*d*), circuit connector (23) (23*a*) (23*b*) (23*c*) and cabling (41). Each fuse element is made up of at least a circuit electrode (25), a bus electrode (26) and a fuse link (43) positioned within a void (42) within an enclosure (24) (24*a*). The bus connector, also known as the fuse connector, has pairs of bus electrode(s) (34) (34*a*) flanked by a pair of slots (29), each of which is adapted for insertion of a pair of the circuit connectors to interlock the bus connector and the circuit connector. The bus connector can be directly connected to battery cable(s) (85). The circuit connector(s) have electrodes (39) which connect to bus electrode(s) and fuse electrodes. Each circuit connector also is attachable to circuit cabling (40).

48 Claims, 7 Drawing Sheets

ELECTRICAL SYSTEMS WITH PAIRED BUS CONNECTORS

BACKGROUND OF THE INVENTION

This invention relates to the fused circuitry aspects of electrical systems and the components of such systems. More particularly, the invention relates to new electrical systems. These systems utilize new, variable width plug fuse units or sets and new types of bus connectors, also known as fuse connectors, and circuit connectors. These systems can also have components positioned on both sides of a support panel, e.g., a vehicular firewall, or can be attached to any support with clamps, screws, etc. Currently, the use of "plug" fuses is dominant in vehicular electrical system designs for low voltage units. This situation is likely to continue because a) the automotive manufacturers are contemplating going to 36-volt systems and b) direct current usage becomes more dangerous as the voltage utilized increases.

The total amount of current carried by modern vehicular fuse blocks is such that the electrical systems are informally divided into high current and low current components. The low current circuitry often uses at least two small fuse blocks to free up valuable space in one or both of the engine compartment and under the dash in the passenger compartment. The separation of the fuse block components also tends to reduce heating problems inherent in the present fusing systems.

The heat problem is currently so important that automotive designers have been using higher amperage but smaller fuses, e.g., a 15-amp plug fuse in a 10-amp circuit, to accommodate the heat generated at the low current fuse blocks in the series wired circuitry of current and past vehicular designs.

The electrical systems of this invention utilize a new approach to wiring systems through the use of plug-type fuses and sets of plug fuses, the widths of which vary with the dimensions of the fuse connector (the new type of fuse "block"). Computer type "webbed" or "ribbon" cable coded with color, pin numbers, etc., can be used to identify specific circuitry. The new combinations substantially reduce fuse and fuse block costs and volumes. The use of parallel circuit wiring and single amperage fuses is preferred and, where utilized, substantially reduce the heating problems at the fuse and fuse block interface. To supply higher amperage capacity to the various components, preferably more fuses are assigned to the cabling connected to that component.

SUMMARY OF THE INVENTION

The new electrical systems utilize a) plug fuses, either as single fuse units or as one or more fuse sets with multiple fuse units with common enclosures; b) a new fuse connector designed for use with the plug fuses, including fuse sets which have adjacent paired bus electrodes and exteriorly positioned pairs of slots; and c) circuit connectors similar to those utilized with computers. The systems also utilize communication connectors to transmit data and power to operating devices, e.g., computers, sensors and activators. The ampere capacity of the plug fuses is preferably the same. However, the amperage capacity of the circuits within the system can be varied to provide desired utility and design.

DETAILED DESCRIPTION OF THE INVENTION

The numbers utilized to identify the elements of the components used in describing the invention are not always consecutive or even sequenced. Variations of initially numbered elements are designated by letters.

Figure 1:
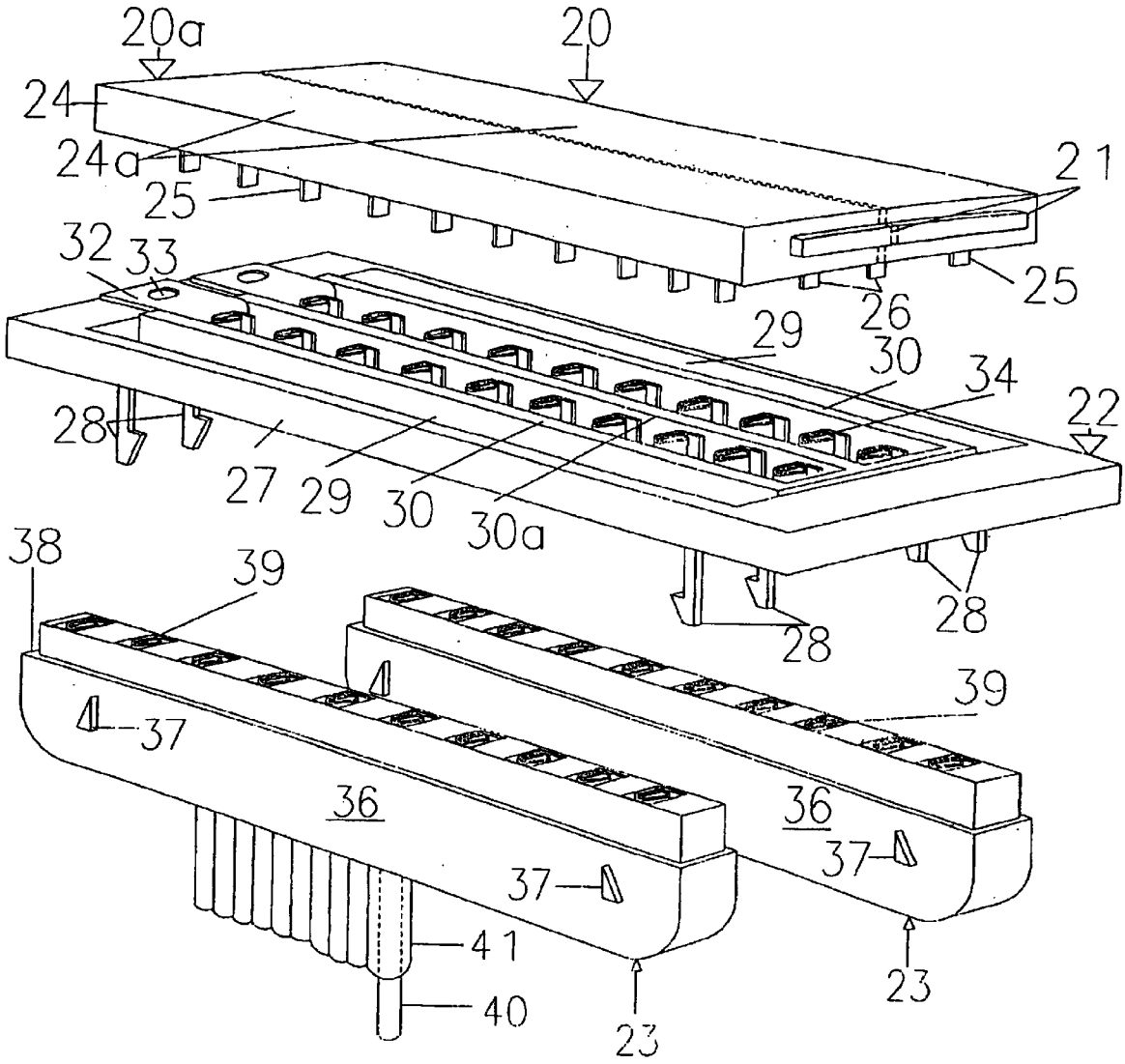
FIG. 1 is an exploded view of the principal components of a preferred 200-ampere electrical system.

FIG. 1 depicts the components of an electrical system fusing arrangement for use with power sources. The power sources can be other than a vehicular type battery and the connection can be made directly without cabling. These include systems where the power is supplied, for example, by alternators, generators, thermoelectric units or solar sources. At the top of FIG. 1 is a pair of fuse sets 20, each with a positioning handle 21. A fuse connector 22 is in the center of FIG. 1 with two circuit connectors 23 below and in position for assembling the fusing portion of an electrical system.

The fuse set 20 includes an enclosure 24, and at least two columns of plug fuse elements, e.g., fuse circuit electrodes 25 and fuse bus electrodes 26. Two sets of single fuses, each having a fuse circuit electrode and a fuse bus electrode, are indicated by the dashed lines. Preferably, each pair of fuse circuit electrodes and fuse bus electrodes is linearly aligned with each other.

The fuse connector 22 includes a frame 27 with downwardly projecting exteriorly positioned latches 28 and two slots 29 between the frame 27 and walls 30. A center wall 30*a* divides walls 30. Walls 30 and center wall 30*a* support fuse sets 20.

Figure 5:
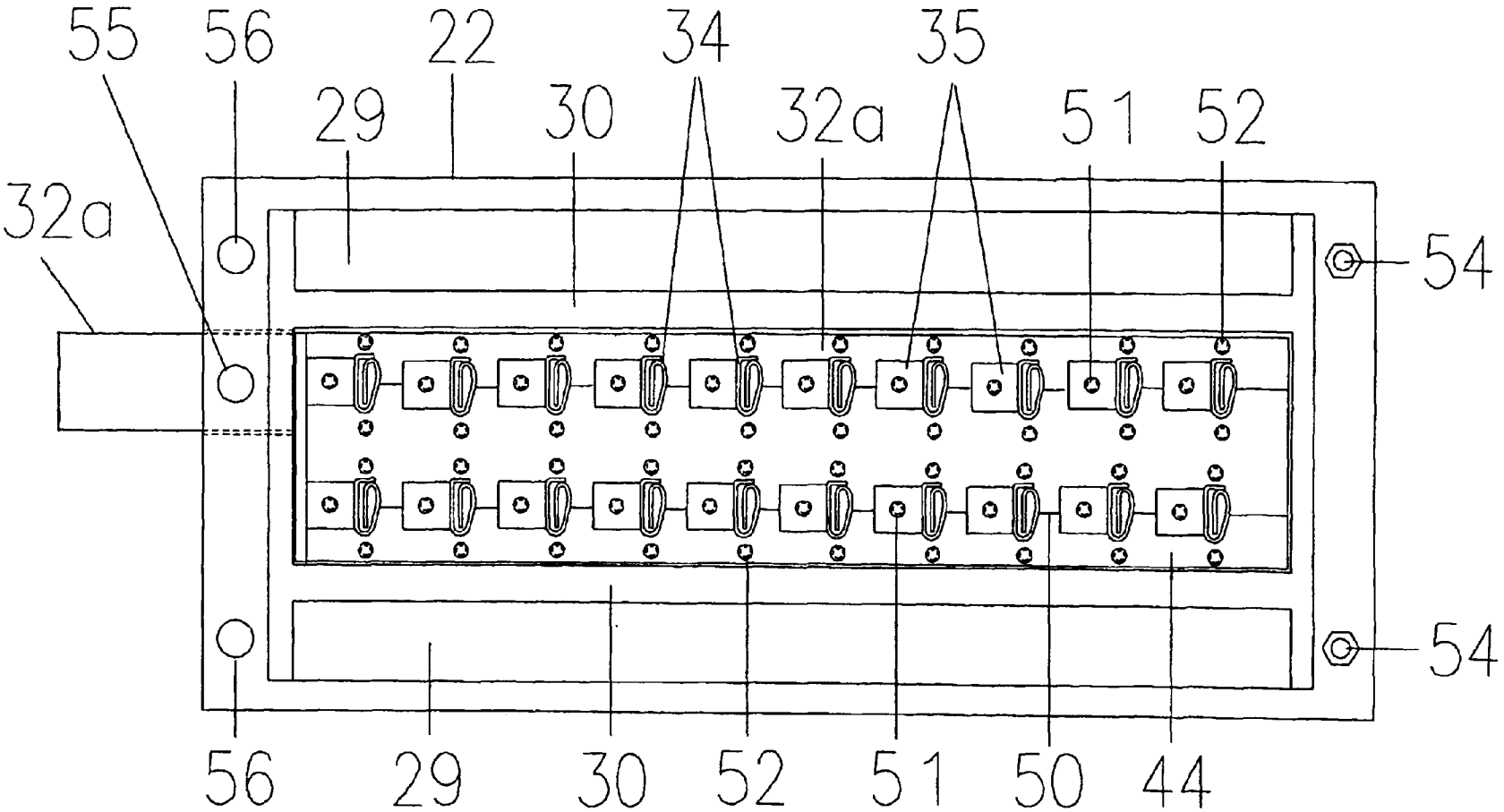
FIG. 5 is a detailed top view of the fuse connector of FIG. 4.
Figure 6:
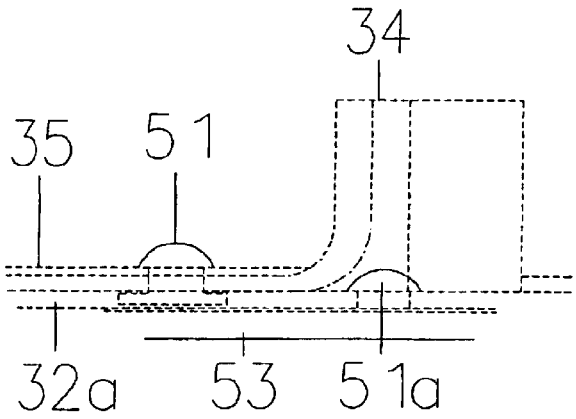
FIG. 6 details the attachment of a coiled female electrode to a bus bar and the bus bar to a supporting "platform."

The bus bars 32 bend downwardly between walls 30 and center wall 30*a* and are attached to coiled female bus electrodes 34 via a right angled extension 35 (See FIGS. 5 and 6). Each of the bus bars 32 have a hole 33 through which a power cable (not shown) can be attached. The bus bar 32 can be independently connected to a power source or can be cut from a single metal sheet and joined on one or both ends. Alternately, the center wall 30*a* can be removed and the electrodes can be attached to a single sheet of metal (See FIG. 5).

Two circuit connectors 23 are made up of a shell 36 on which locks 37 are positioned. Shell 36 encloses at least one row of female coiled circuit electrodes 39. Locks 37 interlock with latches 28 when the fuse connector 22 is seated on the shoulders 38 of shell 36. The circuit connectors 23 interconnect with the plug fuses 20*a* or fuse sets 20, 20*b* through the slots 29. Female coiled circuit electrodes 39 are attached to each of the wires 40 in ribbon cable 41.

Figure 2:
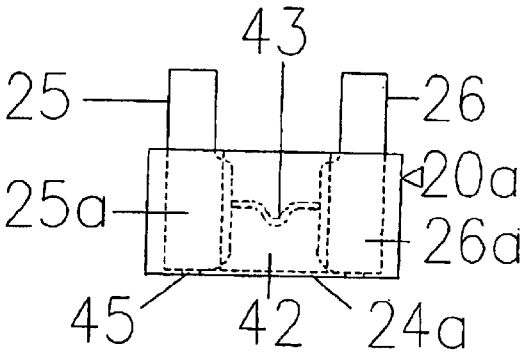
FIG. 2 is a side view of the plug fuse unit and of the fuse sets of this invention.

FIG. 2 depicts a single plug fuse 20*a* having an enclosure 24*a* with a fuse circuit electrode 25 and a fuse bus electrode 26 connected, respectively, to electrode base 25*a* and 26*a* within the enclosure 24*a*. Enclosure 24*a* has a void 42 within which a fuse link 43 is positioned. Each electrode base 25*a* and 26*a* extends toward the edge of enclosure 24*a* to provide a contact point 45 for test equipment probes (not shown).

Figure 3:
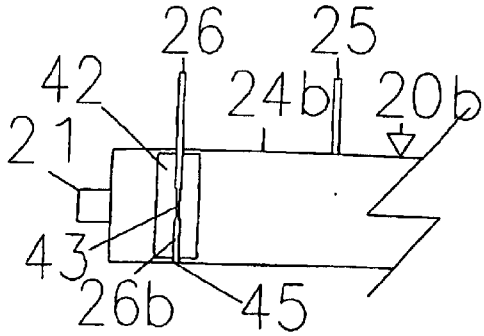
FIG. 3 is a partially cut away section view of a single fuse link of one of a set having a row of plug fuses.

FIG. 3 shows a partial cut-away of one of a single row of fuses in a fuse set 20*b*. The fuse set 20*b* is similar to fuse set 20 shown in FIG. 1 except that enclosure 24 of fuse set 20 comprises two sets of single row fuses and enclosure 24*b* of fuse set 20*b* comprises only one row of fuses. Each fuse circuit electrode 25 and fuse bus electrode 26 are linked through a fuse link 43. Each of electrode bases 25*b* and 26*b* are seated within enclosure 24*b*, their interior edges and fuse link 43 being positioned within void 42. A portion of each electrode base 25*b* and 26*b* extends near or to the outer surface of enclosure 24*b* for contact with test instruments.

Figure 4:
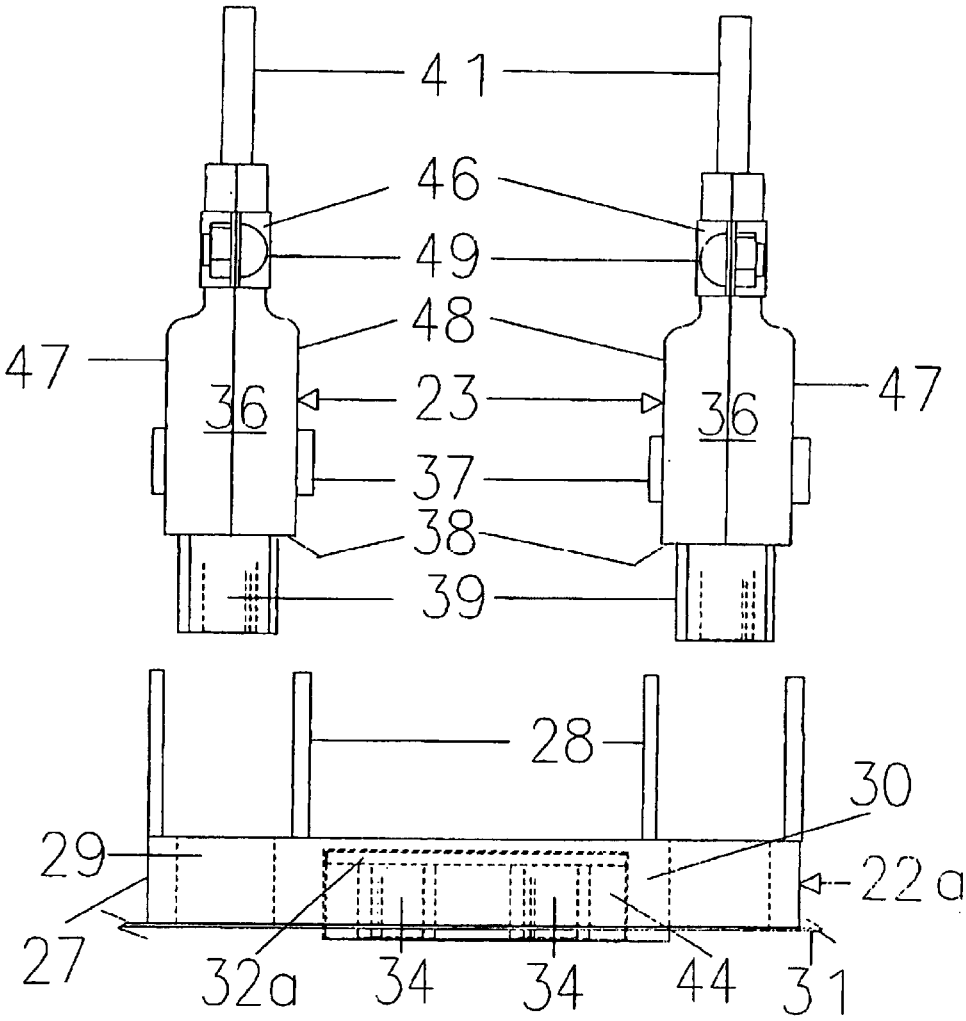
FIG. 4 is an end view of a fuse connector with a pair of rows of bus electrodes and slots positioned below a pair of circuit connectors.

FIG. 4 provides additional detail regarding the interplay between the fuse connector 22 and the circuit connectors 23. As shown, the support panel 31 is positioned at the bottom of a fuse connector 22 with the fuse connector electrodes 34 being held in place by bus bar 32*a* within the space 44. A pair of exteriorly positioned slots 29 receives and forms a seat for each of a pair of circuit connectors 23. Each of the fuse connector electrodes 34 receives a bus electrode 26 of a fuse 20*a* or fuse set 20, 20*b* and each of the circuit electrodes 39 seats a circuit electrode 25. (See also FIGS. 1, 5). Latches 28 extend to engage locks 37 of circuit connectors 23.

The circuit connectors 23 are shown with shell clamps 46 holding the two sides 47 and 48 of shells 36 together with a nut and bolt assembly 49. Latches 28 will flex toward the viewer as circuit connectors 23 are lowered to the point where the latches 28 seat over the top of locks 37, then return to their original position to ensure good contact and alignment between the fuse connector 22 and circuit connectors 23. Shoulders 38 rest on the top of frame 27 to ensure alignment.

FIG. 5 depicts the fuse connector 22 of FIG. 4 with two rows of bus electrodes 34 attached to a common bus bar 32*a* by rivets 51. Two slots 29 are externally positioned with respect to the rows of the bus electrodes 34.

Figure 7:
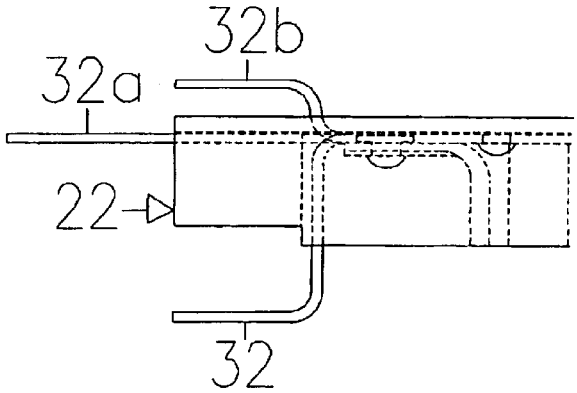
FIG. 7 details the positioning of the bus bar connections of a fuse connector.

FIGS. 6 and 7 also provide details of portions of the preferred fuse connector 22 configuration. The right angled extensions 35 of coiled bus electrodes 34 are connected to the bus bar 32*a*. Bus bar 32*a* has an upward "v" crimp 50 (See FIG. 5) which exerts pressure between the bus bar 32*a* and a similar crimp in right angled extensions 35 (not shown) to ensure a tight connection and proper alignment. Typically, the attachment rivets 51 would be wedge headed rivets. These rivets, along with electrodes 26, 39, and bus bar 32*a*, would be of a conductive material. Bus bar 32*a* is attached to a platform 53 (see FIG. 6) which forms a bus bar 32*a* support between walls 30. In fabrication of the fuse connector 22, typically, plastic nipples are formed in platform 53 which protrude through holes (not shown) in bus bar 32*a* and are flattened by pressure or heat and pressure to form rivet 51*a*. As seen in FIG. 7, bus bars 32, 32*a* and 32*b* are configured to connect with power supplying electrodes as needed.

Figure 8:
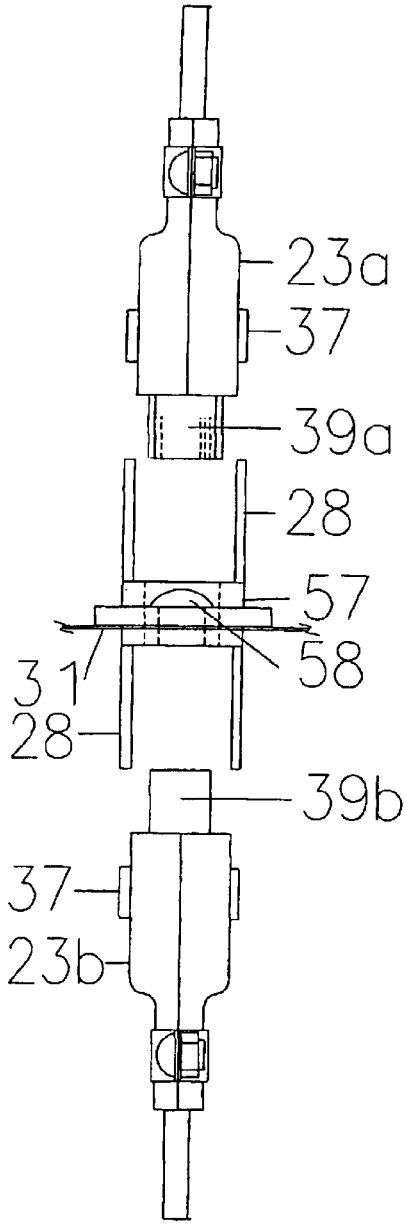
FIG. 8 depicts end views of two communication circuit connectors and a trans-support panel connector that positions them.

FIG. 8 depicts a trans-support panel positioning unit 57 which locks a female communication circuit connector 23*a* and a male communication circuit connector 23*b* in place on opposite sides of a support panel 31. The trans-support panel positioning unit 57 is attached to the support,panel 31 by screws 58. Female circuit electrodes 39*a* and male circuit electrode 39*b* connect the communication circuits when both connectors 23*a* and 23*b* are locked in place.

Figure 9:
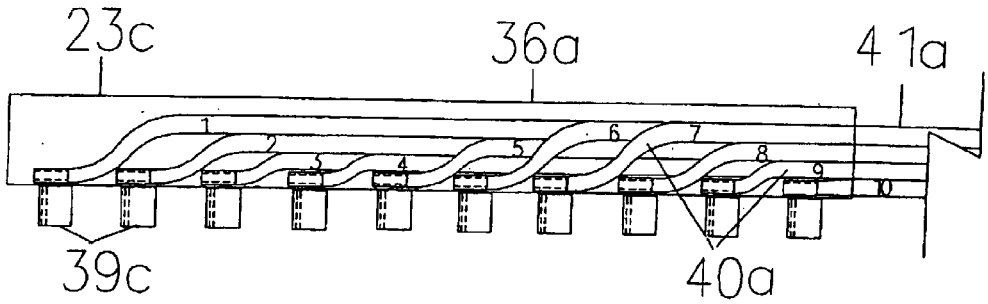
FIG. 9 is a side view of a preferred circuit connector providing wire identification.
Figure 10:
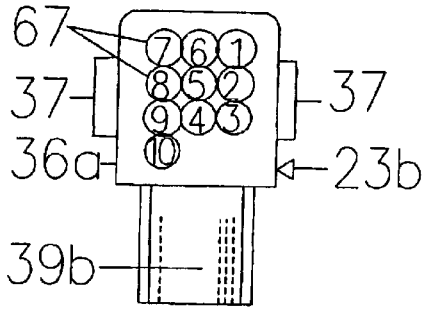
FIG. 10 depicts an end view of the circuit connector of FIG. 9.

FIGS. 9 and 10 show a preferred third model of a circuit connector 23*c* which brings folded ribbon cable 41*a* into a molded shell 36*a*. The wires 40*a* of ribbon cable 41*a* are numbered for reference and connect to female electrodes 39*c* which project externally of shell 36*a*. FIG. 10 shows the numbered positions 67 of the ribbon cable 41*a* leads (not shown) with stops 37 on shell 36*a*.

Figure 11:
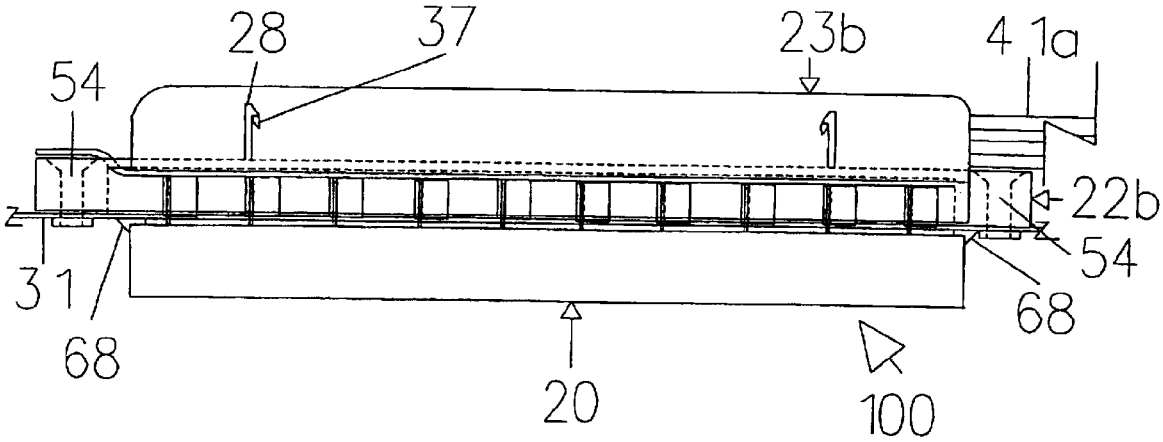
FIG. 11 depicts a side view of the assembled combination of the connector of FIG. 9, a fuse set and a fuse connector.

FIG. 11 indicates the compactness of an assembled and fused "fuse block" unit 100, shown actual size, having a 200-amp assembly of twenty 10-amp fuses configured as two rows each having ten fuses. The preferred unit 100 shown combines a fuse connector 22*b* with a fuse set 20 and circuit connector 23*b* across a support panel 31. A seal 68, fluid or solid, is interposed between fuse set 20 and support panel 31 to protect against water and other contamination and to ensure better heat transfer. Seal 68 can be a solid or a fluid seal of silicone, rubber, etc.

Figure 12:
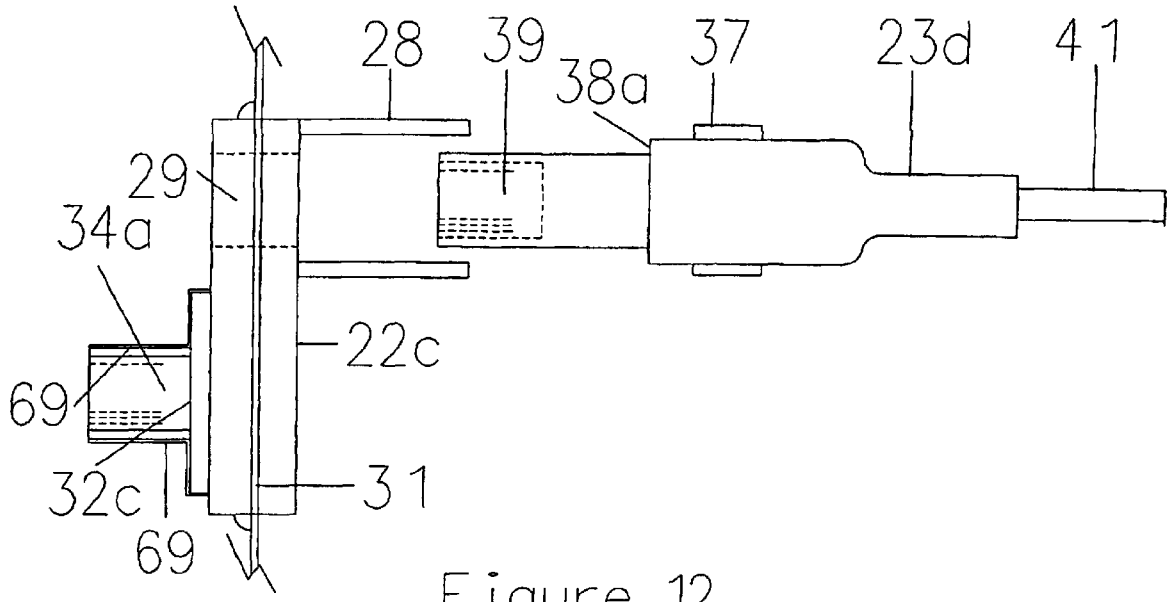
FIG. 12 depicts an end view of a circuit connector and a fuse connector with a single row of surface mounted electrodes.

FIG. 12 includes a fuse connector 22*c* and a communication connector 23*d*. The fuse connector 22*c* has a slot 29 on one side and a surface-mounted bus bar 32*c* on the other. The bus bar 32*c* and electrode 34*a* have an external, tough electrically insulated coating 69 to protect against inadvertent contact between the "hot" bus bar 32*c* and electrodes 34*a* and users. The shoulder 38*a* and locks 37 of communication connector 23*d* are positioned at a greater distance from the slot 29 for the electrodes 34 than other models of the circuit connectors 23.

Figure 13:
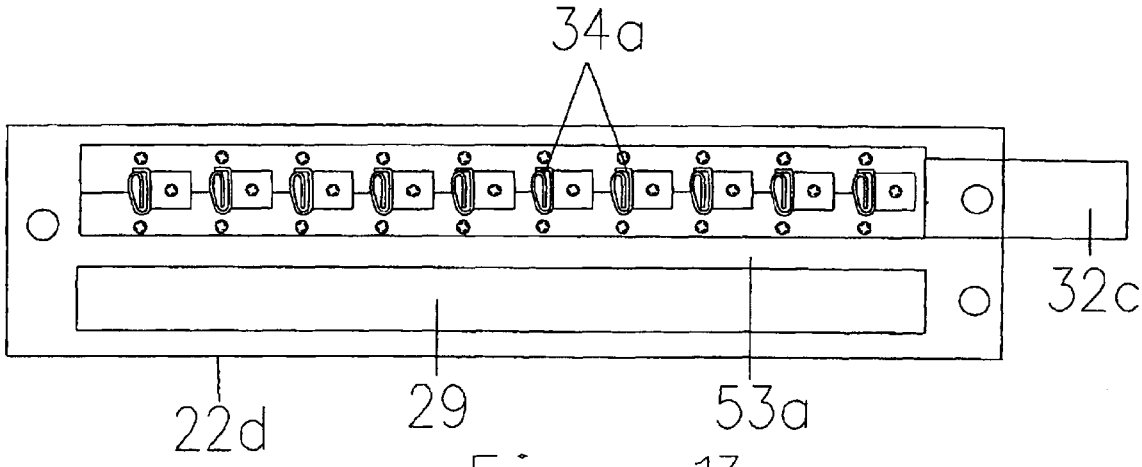
FIG. 13 is a top view of the fuse connector of FIG. 12 sharing with a single row of electrodes and a single slot.

The fuse connector 22*d* of FIG. 13 has a single slot and surface-mounted bus bar 32*c*. Bus bar 32*c* and electrodes 34*a* have external surface electrically insulating coatings (not shown).

Figure 14:
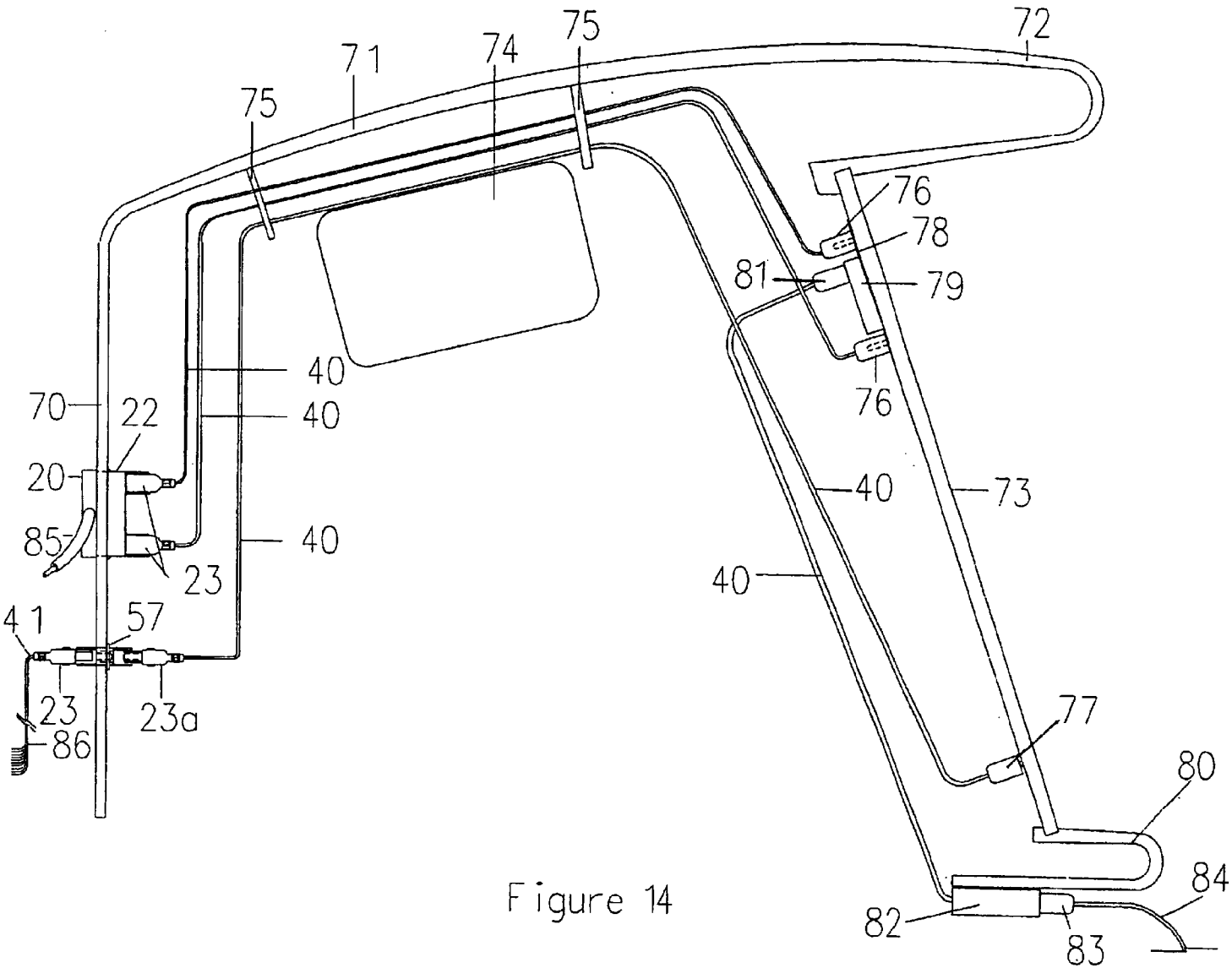
FIG. 14 depicts a simplified assembled vehicular electrical system.

FIG. 14 provides a simplified diagram of an automotive firewall 70, the dash cover 71 and dash sunshade frame 72 over the dash display 73 and heater duct 74 structures. Under dash cover 71, cable supports 75 position ribbon cables 40 as they move from circuit connectors 23 and 23*a* over the heat duct 74. Dash display 73 is electrically powered by cables 40 through female connectors 76 which connect to circuit board 78. Electric signals from circuit board 78 actuates the dash display 73, not shown, and the computer and control functions of control compartment 79. It also provides computer and servo control of sensors and actuators (not shown) controlled by the computer (not shown) through cable 40 from communication connector 77 at the bottom of the dash display 73.

Sensed data from the sensors (not shown) in the engine compartment (not shown) and control data from circuit board 78 and control compartment 79 are transmitted back and forth across the firewall 70 via trans firewall connector unit 57 and circuit connectors 23 and 23*a*. Power is supplied to fuse connector 22 by battery cable 83. The power then passes through fuse connector 22, fuse set 20, and circuit connectors 23 ribbon cables 40 to the circuit board 78 and dash display 73.

A computer read-out is supplied to a remote mechanic's computer through computer circuit connector 81, ribbon cable 40 and female computer socket 82. The mechanic's computer input plug 83 with its computer cable 84 is shown plugged into the plug 82 under dust shield 80. Electric power consuming sensors and actuators are identified by the spreading wires 86 of the ribbon cable 41.

GENERAL DESCRIPTION OF THE INVENTION

The applications of the systems of this invention include all power systems. Examples include but are not limited to vehicular, e.g., aircraft and research submersibles; automated remote observatories, e.g., satellites; and weather stations; security systems, e.g., for home office, remotely stores supply depots and equipment and biomedical devices, e.g., insulin pumps.

The expected primary use will be vehicle electrical systems, e.g., automotive. Higher amperage, fused systems can also be used for mobile and stationary heavy equipment. In fact, the systems can be used universally, preferably with parallel wiring systems. The total amperage of a given system design can be easily modified to meet a desired amperage fusing capacity by shortening or lengthening the exemplary systems described or having two or more joined fuse units or sets, fuse connectors and circuit connectors. The various connectors and the fuses or fuse sets can be configured and locked together using a variety of attachment mechanisms, e.g., screws. The identification numbers, color, shape and fastener mechanisms utilized with connecting components making up computers can also be used in the plug and play systems taught herein. The plug fuses and various electrode metals normally utilized will be those which are appropriate for their use.

While the systems described are shown in the preferred mode for use across support panels, they can be utilized where a support panel is not required with little or no modification of the circuit connectors and the bus connector (s).

The use of 10-ampere fuses with coiled electrodes is preferred. The coiled electrodes provide two complete side surfaces to male spade electrodes while the standard female electrode provides only one and a fractional side surface. Both lower and higher amperage fuses can be used. Lower amperage fuses, e.g., 5-ampere, increase costs by, e.g., substantially the increasing number of fuses, bus electrodes and wiring in the systems. Higher amperage fuses, e.g., 15-ampere fusing, leads to the higher fuse/fuse block electrode temperatures that presently plague designers of electrode/fuse block electrode designs.

While the fuses are described in terms of male electrodes and the communication and bus connectors are described in terms of female electrodes, either set of electrodes can either or both genders, e.g., for identification purposes. However, exposed bus electrodes and bus bars should be insulated against inadvertent contact by the users of the systems, mechanics, and grounding objects. Similarly, while coiled female electrodes are preferred because of their greater contact area and more even pressures, other more common female electrodes can be substituted. The platforms used are preferably plastic, e.g., polyamides, polyesters, polyformals, and various high molecular weight polyolefins.

The manufacturer of commercial components making up the systems of this invention should design their components to meet the standards established by The Society of Automotive Engineers, Underwriters Laboratories (UL) and similar organizations and should comply with any regulations established by the government(s) and their agencies relating to the vehicles and other equipment, etc., appropriate to each system's usage. Manufacturers, marketers, buyers and users are warned to study the required standards, laws and regulations pertaining to manufacturing, marketing and usage or the systems and components and to conduct such operations in a way that is safe for the environment, the manufacturer's employees, distribution personnel, mechanics and the end users on both a short and long-term basis.

What is claimed is:

1. An electrical system for transmitting power from an electrical power source to at least one electrical power consuming circuit, the system comprising:

a circuit connector comprising a shell having at least one circuit electrode mounted therein, said shell having a mating portion;

a fuse connector comprising a frame having at least one bus electrode mounted therein, the frame having at least one slot, wherein said fuse connector is removably connectable to said circuit connector by positioning said mating portion of said shell into said slot;

wherein said slot flanks said bus electrode;

at least one plug fuse removably connectable to the bus electrode and to the circuit electrode; and wherein said circuit electrode is coiled.

2. The system of claim 1, wherein said circuit connector further comprises a lock means functioning to secure said fuse connector to the circuit connector when the fuse connector is connected to the circuit connector.

3. The system of claim 2, wherein the shell of said circuit connector has a shoulder to seat the mating portion in said slot of the frame.

4. The system of claim 1, wherein said circuit electrode is attached to a wire in a ribbon cable.

5. The system of claim 4, wherein said fuse connector, said circuit connector, and said wire include at least one identification means.

6. The system of claim 1, wherein said fuse connector further comprises a bus bar attached to said bus electrode.

7. The system of claim 6 further comprising an insulated coating external to said bus bar and said bus electrode to prevent inadvertent contact by a user and a powered bus bar and bus electrode.

8. The system of claim 1, wherein said fuse connector has at least two slots for engaging at least a portion of two circuit connectors.

9. The system of claim 1, wherein said fuse connector has at least two rows of substantially centrally positioned bus electrodes and at least two externally positioned slots.

10. The system of claim 1, wherein said plug fuse is a single plug fuse.

11. The system of claim 1, wherein a plurality of said plug fuses form a fuse set.

12. The system of claim 11 further comprising a support panel and a seal interposed between said fuse set and said support panel to protect against contaminants and to ensure heat transfer.

13. The electrical system of claim 11 further comprising a communication connector removably connectable to a base of said circuit connector to transmit data and/or power to an operating device.

14. The electrical system of claim 13, wherein said communication connector further comprises a trans-support panel fixture, said panel fixture having a male and female communication connector and lock means functioning to secure said male communication connector to said female communication connector on opposite sides of a support panel.

15. The electrical system of claim 13 further comprising a dash means functioning to display sensed data.

16. The system of claim 1, wherein said fuse connector and said circuit connector form a part of a vehicular electrical system.

17. The system of claim 1 further comprising a communication connector removably connectable to a base of said circuit connector to transmit data and/or power to an operating device.

18. The electrical system of claim 1, wherein said fuse connector is directly connectable to a power source.

19. The electrical system of claim 18, wherein at least one fuse electrode and at least one circuit electrode of each of a pair of plug fuses, said fuse electrode and said circuit electrode having predetermined dimensions, connects to a correspondingly sized fuse connector and at least one circuit connector.

20. The electrical system of claim 1, wherein said fuse connector further comprises cable means for connection to a battery.

21. An electrical system for transmitting power from an electrical power source to at least one electrical power consuming circuit, the electrical system comprising:

at least two circuit connectors, each comprising a shell having at least one circuit electrode linearly mounted therein, each of said shells having a mating portion;

a bus connector comprising a frame having at least two substantially centrally positioned bus electrodes linearly mounted therein, the frame having at least two slots flanking said bus electrodes;

wherein said bus connector is removably connectable to each of said circuit connectors by positioning each mating portion of said shells into a corresponding one of said slots;

at least one plug fuse having two male ends, wherein one end comprises a bus electrode, and one end comprises a circuit electrode, each male bus electrode end of said plug fuse being linearly, removably connectable to a corresponding one of said bus electrodes mounted in said bus connector, each male circuit electrode end of said plug fuse being linearly, removably connectable to a corresponding one of each of said circuit electrodes mounted in said shell of said circuit connector; and wherein said circuit electrode is coiled.

22. The electrical system of claim 21, wherein a plurality of said plug fuses are mounted to an enclosure and spaced apart thereon to form a fuse set.

23. The electrical system of claim 22 further comprising a communication connector removably connectable to a base of said circuit connector to transmit data and/or power to an operating device.

24. The electrical system of claim 22, wherein each of said bus electrodes is attached to a bus bar.

25. The electrical system of claim 22, wherein said bus connector and at least one circuit connector are constructed to connect to at least one fuse set containing at least one plug fuse.

26. The electrical system of claim 25, wherein said bus connector is directly connectable to a power source.

27. The electrical system of claim 21, wherein each of said circuit connectors further comprises a lock means functioning to secure said bus connector to each of the circuit connectors when the bus connector is connected to each of the circuit connectors.

28. The system of claim 27, wherein the shell of each of said circuit connectors has a shoulder to seat each of said mating portions in each of said slots of the frame.

29. The electrical system of claim 21, wherein said circuit electrode is attached to a cabling wire.

30. The electrical system of claim 29, wherein said cabling wire is ribbon-type cabling wire.

31. The electrical system of claim 29, wherein said cabling wire is wrapped harness cabling wire.

32. The electrical system of claim 29, wherein said bus connector, each of said circuit connectors, and said cabling wire includes at least one identification means.

33. The electrical system of claim 21, wherein said bus connector further comprises cable means for connection to a battery.

34. The electrical system of claim 21, wherein said bus connector and each of said circuit connectors form a part of a vehicular electrical system.

35. The electrical system of claim 21 further comprising a communication connector removably connectable to a base of said circuit connector to transmit data and/or power to an operating device.

36. The electrical system of claim 35, wherein said communication connector further comprises a trans-support panel fixture, said panel fixture having a male and female communication connector and lock means functioning to secure said male communication connector to said female communication connector on opposite sides of a support panel.

37. The electrical system of claim 35 further comprising a dash means functioning to display sensed data.

38. A fuse connector for use in an electrical system for transmitting power from an electrical power source to at least one electrical power consuming circuit, said fuse connector comprising:

a frame means functioning to support at least two rows of substantially centrally positioned female bus electrodes; and at least one pair of slot means adjacent to and on opposite sides of said rows of female bus electrodes, each of said slot means functioning to receive a mating portion of a circuit connector, said mating portion having at least one row of female coiled circuit electrodes mounted therein.

39. The apparatus of claim 38, wherein said frame means further comprises downwardly projecting exteriorly positioned latch means functioning to secure said fuse connector to said circuit connector when said use connector is seated upon a shoulder of the circuit connector.

40. The apparatus of claim 39, wherein said fuse connector is directly connectable to a power source.

41. The apparatus of claim 38, wherein each of said female bus electrodes is attached to a bus bar means via an angled extension on each female bus electrode, said bus bar means functioning to transmit power from a power source to each of said attached female bus electrodes.

42. The apparatus of claim 41, wherein said bus bar means further comprises at least one upward crimp exerting pressure on at least one corresponding upward crimp of said angled extension to ensure proper alignment and a tight connection between said bus bar means and said angled extension.

43. The apparatus of claim 38, wherein each of said female bus electrodes receives a male end of a plug fuse bus electrode or fuse set.

44. The apparatus of claim 38, wherein a male end of a plug fuse circuit electrode or fuse set seats a corresponding one of said female coiled circuit electrodes when said circuit connector is inserted through each of said slot means.

45. The apparatus of claim 38, wherein said frame has a plurality of slots.

46. An electrical system for transmitting power from an electrical power source to at least one electrical power consuming circuit, the system comprising:

circuit connector means functioning to house a shell means having at least one circuit electrode mounted therein, said shell means having a mating portion;

said shell means functioning to removably penetrate a slot of a fuse connector means and interact with at least one plug fuse or fuse set;

fuse connector means functioning to house at least one bus electrode, said fuse connector means having at least one slot, wherein said slot flanks said bus electrode, wherein said slot removably receives the mating portion therein;

at least one plug fuse means functioning to connect the bus electrode to the circuit electrode; and wherein said circuit electrode is coiled.

47. The system of claim 46 further comprising cable means functioning to transmit data and power to an operating device.

48. The system of claim 47 further comprising lock means functioning to secure said fuse connector means to said circuit connector means when the fuse connector means is seated upon said shoulder of the circuit connector means.

* * * * *